US006070039A

United States Patent [19]

Yamaki et al.

[11] Patent Number: 6,070,039

[45] Date of Patent: May 30, 2000

[54] METHOD AND APPARATUS FOR REMOVING DEVELOPER FROM A DEVELOPER CARRIER

[75] Inventors: Hideo Yamaki; Hiroyuki Maeda; Hiromasa Ueno, all of Toyokawa, Japan

[73] Assignee: Minolta Co., Ltd., Osaka, Japan

[21] Appl. No.: 09/192,510

[22] Filed: Nov. 17, 1998

[30] Foreign Application Priority Data

| | | | |
|---|---|---|---|
| Nov. 18, 1997 | [JP] | Japan | 9-316728 |
| Dec. 3, 1997 | [JP] | Japan | 9-333302 |
| May 21, 1998 | [JP] | Japan | 10-139391 |

[51] Int. Cl.[7] ..... G03G 15/08

[52] U.S. Cl. ..... 399/283; 399/273; 399/285

[58] Field of Search ..... 399/283, 119, 399/252, 267, 273, 285

[56] References Cited

U.S. PATENT DOCUMENTS

| | | | |
|---|---|---|---|
| 5,592,265 | 1/1997 | Sakuraba et al. | 399/283 X |
| 5,600,419 | 2/1997 | Sakuraba et al. | 399/283 X |
| 5,708,921 | 1/1998 | Yagi et al. . | |
| 5,978,635 | 11/1999 | Azuma et al. | 399/283 |

*Primary Examiner*—Quana Grainger

*Attorney, Agent, or Firm*—Burns, Doane, Swecker & Mathis, LLP

[57] ABSTRACT

An apparatus for removing developer from a developer carrier includes a developer-charge-eliminating means including a first elastic member. The first elastic member is electrically conductive and contacts the developer carrier with an uneven surface. Preferably, the uneven surface includes exposed cells of a foamed body. The uneven surface of the first elastic member insures that sufficient contact and frictional resistance is applied to excess developer on a developer carrier. Preferably, the first elastic body is backed by a backing member which is more flexible than the first elastic member. The flexible second elastic body further insures that the charge-eliminating member sufficiently contacts the developer carried by the developer carrier even with extended use.

27 Claims, 9 Drawing Sheets

METHOD AND APPARATUS FOR REMOVING DEVELOPER FROM A DEVELOPER CARRIER

This application is based on applications Nos. 9-316728, 9-333302, and 10-139391 filed in Japan, the contents of which are hereby incorporated by reference.

BACKGROUND OF THE INVENTION

1. Field of the Invention

The present invention relates to a developing apparatus which is used in electrophotographic type copy machines and printers. More particularly, the present invention relates to a developing apparatus which easily removes developer remaining on a developer carrier after development of an image. Removal of developer remaining on the development carrier is accomplished by making an elastic member for eliminating charge better contact developer on the developer carrier. The present invention also relates to an image forming apparatus using such a developing apparatus, and a development method carried out by the developing apparatus.

2. Description of the Prior Art

A developing apparatus has been used wherein a thin layer of developer is formed on a developer carrier and latent images are developed with the thin layer of developer. In this conventional developing apparatus, excess toner remains on a developer carrier even after development (i.e., after developer is imparted onto an image retaining carrier). Preferably, the excess toner is once removed from the developer carrier. Then, following the removal of the excess toner, a uniform, thin layer of developer is formed on the developer carrier. However, defective images including uneven density, vertical stripes or the like appear unless a thick uniform layer of developer is constantly formed on the developer carrier during the development operation.

An example of typical structure of such a conventional developing apparatus is shown in FIG. 11. This developing apparatus 100 has a rotating development sleeve 104 contacting a photosensitive drum 40. A supply roller 109 supplies toner to the development sleeve 104. A stirring blade 110 stirs toner present in a developer storage tank 102. A regulating blade 108 and a charge-eliminating sheet 106 are made to press against a periphery of the development sleeve 104.

The regulating blade 108 causes an even, thin layer of toner to be formed on the development sleeve 104 and also negatively charges the toner. The charge-eliminating sheet 106 removes toner remaining on the development sleeve 104 after image development by eliminating charge on the remaining toner. The charge-eliminating sheet 106 is flexible, resists the adhesion of melted toner, and resists abrasion. An electrically conductive member which has some electrical resistivity is used for the charge-eliminating sheet 106. Some electrical resistivity is required so that overcurrent will not flow to the charge-eliminating sheet 106 when toner on the development sleeve 104 runs out and the charge-eliminating sheet 106 directly contacts with the development sleeve 104. More specifically, a conductive fluorocarbon resin sheet or the like is used for the charge-eliminating sheet.

Further, the developing apparatus 100 has an electric power unit 112 which applies both voltage for eliminating charge and bias voltage for developing an image. As shown in FIG. 12, voltage is applied to the charge-eliminating sheet 106 from its end.

The developing apparatus 100 operates as follows. First, toner present in the developer storage tank 102 is supplied to the development sleeve 104 by rotation of the supply roller 109. Then, toner is made into a uniform, thin layer by the regulating member 108 and carried onto the development sleeve 104. Next, the uniform, thin layer of toner is supplied to electrostatic latent images on the photosensitive drum 40 and the images are developed. Toner not used for development (i.e., excess toner remaining on the development sleeve 104 after development of the latent images) is transported by rotation of the development sleeve 104 to come into contact with the charge-eliminating sheet 106. Voltage as described above is applied to the charge-eliminating sheet 106. The polarity of the voltage is opposite the polarity of charged toner. Therefore, the charge on the toner is eliminated. As a result, the charge-eliminated toner can be removed from the development sleeve 104. Subsequently, a new, thin layer of toner is formed on the development sleeve 104.

However, the aforementioned conventional developing apparatus 100 has a problem in that a charge-eliminating voltage cannot be applied uniformly in a longitudinal direction to a toner layer remaining on the development sleeve 104. As shown in FIG. 12, voltage is applied from one of the longitudinal ends of the charge-eliminating sheet 106. Because the charge-eliminating sheet 106 has some electrical resistivity, the potential drop becomes larger as the distance from the point at which a voltage is applied (voltage-applied point) increases. Therefore, the potential of the charge-eliminating sheet 106 is not uniform. Where the voltage drop is large (right side in FIG. 12) the charge-eliminating sheet has a poor charge-eliminating effect.

Moreover, a charge-eliminating voltage cannot be applied to the entire thickness of the toner layer remaining on the development sleeve 104 after development. The developing apparatus 100 can apply a charge-eliminating voltage only to a portion of the toner layer remaining on the development sleeve 104. Since the surface of the charge-eliminating sheet 106 is smooth, the charge-eliminating sheet 106 contacts only the surface portion of the toner layer. Therefore, other than at its surface, the charge on the toner layer remaining on the development sleeve 104 after development is not sufficiently eliminated.

Due to the above-mentioned conditions, charged toner which was not eliminated can remain on the development sleeve 104 as a new thin layer of toner is formed over the remaining toner. The increased amount of toner adhering onto the development sleeve 104 causes defective images containing fog, uneven density, zebra patterns, or other noise. Further, toner which was not eliminated accumulates on the development sleeve 104 during a long period of continuous printing. Consequently, a thin film of resin including a toner component, (filming) is created. Filming causes image defects such as fog. This effect is most noticeable at a zone far from the voltage-applied point where there is little charge-eliminating effect. Further, this effect is very noticeable in an initial printing period when the amount of charged toner is large and the toner is in a low-humidity condition.

It is generally known that the charge-eliminating effect increases when a charge-eliminating sheet more firmly presses against a development sleeve. Accordingly, the above mentioned problems may be mitigated using this technique. However, if the charge-eliminating sheet 106 presses to firmly against the development sleeve 104, other undesirable conditions are created such as irregular driving of the development roller 104, requiring a large-sized driving device for the development sleeve 104. Therefore, it may not be feasible to increase the firmness with which the charge-eliminating sheet 106 presses against the development sleeve 104.

SUMMARY OF THE INVENTION

The present invention can mitigate the above-described problems of a conventional developing apparatus. One object of the present invention is to provide a developing apparatus or development method wherein the contact probability for a developer-removing member for toner remaining on a developer carrier after development is increased so that the remaining developer can surely be removed without having a developer-charge-eliminating member press against the development sleeve too firmly. Another object of the present invention is to provide a developing apparatus wherein voltage for eliminating charge is applied uniformly in a longitudinal direction to the developer remaining on the developer carrier after development so that the remaining developer can be evenly removed. Thereby, the present invention provides an image forming apparatus which can obtain an excellent image free from image defects such as fog.

In order to achieve the above objectives, the inventive developing apparatus includes a developer carrier for carrying developer and developer-charge-eliminating means for eliminating charge on developer on the developer carrier. The developer-charge-eliminating means includes an electrically conductive first elastic member which contacts the developer carrier. An uneven surface of the first elastic member contacts the developer carrier.

In the inventive developing apparatus, the developer-charge-eliminating means includes an electrically conductive first elastic member wherein a surface of the first elastic member which contacts the developer carrier is uneven. Thereby, the contact probability and frictional resistance between developer-charge-eliminating means and the developer remaining on the developer carrier after development is enhanced. That is, the first elastic member for the developer-charge-eliminating means contacts not only the surface portion of the layer of developer remaining on the developer carrier after development, but also the entire thickness of the layer.

Thereby, when a voltage for eliminating charge (a voltage having a polarity opposite of the charged developer) is applied to the first member, the voltage is applied to the entire thickness of the layer of developer remaining on the developer carrier after development. Thereby, all of the charge on developer remaining on the developer carrier is surely eliminated. Therefore, developer remaining on the developer carrier after development can surely be removed. Therefore, toner to be carried onto the developer carrier can be totally replaced. As a result, a thin layer of developer newly formed on the developer carrier for the next development is constantly uniform.

Further, in the inventive developing apparatus, preferably a second elastic member which is more flexible than the first elastic member is arranged on a back surface of the first elastic member. The word back surface defined here is a surface opposite the surface contacting the developer carrier. When the second elastic member is arranged like this, the contact state between the first elastic member and the developer carrier is preserved, even when plastic deformation of the first elastic member occurs due to extended use. Therefore, the charge-elimination performance of the first elastic member is maintained. The second elastic member is not necessarily electrically conductive. However, the second elastic member can have better conductivity than the first elastic member. In the case where the second elastic member has better conductivity than the first elastic member, voltage for eliminating charge can be first applied to the second elastic member and then to the first elastic member through the second elastic member.

Further, in the inventive developing apparatus, the first elastic member is a foamed body, and preferably, a surface of the first elastic member which contacts the developer carrier has an exposed foamed-state uneven surface. Thereby, the first elastic member of the developer-charge-eliminating means more surely contacts the entire thickness of a layer of developer remaining on the developer carrier after development. Thereby, all the developer on the developer carrier can be replaced after development. Therefore, the next development can be carried out with a thin layer of developer newly formed on the developer carrier. Further, since a foamed body is used for the first elastic member, it is easy to maintain the roughness of the uneven surface. The foamed-state uneven surface defined herein means an uneven surface with foam cells appearing on a cut surface when a foamed body is randomly cut.

Further, in one embodiment, the surface resistance value of the foamed body for the first elastic member is preferably lower than $10^8$ Ω, and the number of cells in the foamed body is preferably more than 20 cells/25 mm. This is because charge-eliminating effect drops when the resistance value of the first elastic member is too high. In addition, this is because the contact probability and frictional resistance to toner become insufficient when the number of cells is too small.

On the other hand, if the resistance value is too small, overcurrent may flow when developer on the developer carrier runs out allowing the first elastic member and the developer carrier to directly contact each other. Therefore, the surface resistance value is preferably made larger than $10^2$ Ω. Thus, when the resistance value of the first elastic member is the above-mentioned value, a sufficient charge-eliminating effect is created and overcurrent is prevented even when the foamed body directly contacts the developer carrier.

Additionally, too many cells for the foamed body are also inappropriate. Therefore, the number of cells is preferably made less than 80 cells/25 mm. Thereby, appropriate contact probability and frictional resistance can be obtained. The unit, "cells/25 mm", indicates the number of cells on which a 25-mm straight line crosses. Further, the form of a cell may be either a continuous foam form or an isolated foam form, but a continuous foam is preferred.

The inventive developing apparatus has a developer carrier for carrying developer, and developer-charge-eliminating means for eliminating the charge on developer on the developer carrier. The developer-charge-eliminating means can include an electrically conductive first elastic member which contacts with the developer carrier and a second elastic member which is arranged on a back surface of the first elastic member and which is more flexible than the first elastic member.

Further, the first elastic member should be made harder than the second elastic member because the second elastic member has to be more flexible than the first elastic member.

In the inventive developing apparatus the second elastic member preferably has one or more slits along the width of the developer carrier. The developer carrier which the first elastic member contacts is not always an ideal cylindrical form. Within a tolerable range, the developer carrier may have variable circumferential lengths along its width. When the second elastic member includes slits to divide the member along its width, the development carrier can press and contact the first elastic member somewhat independently with each divided section. The slit can be a simple cut having no width or it can be a gap having some width. Moreover, the slits can be deep enough to divide the second elastic member thoroughly or they can be a shallow ditch-like slits which do not divide the second elastic member.

Further, the first elastic member is preferably wider than the second elastic member. Thereby, the required driving torque for the developer carrier can be reduced.

Moreover, in the inventive developing apparatus, a foamed body is preferably used for both the first elastic member and the second elastic member. In this embodiment, preferably the number of foamed cells for the second elastic member is more than that for the first elastic member because the second elastic member should be more flexible than the first elastic member.

Alternatively, the inventive developing apparatus has a developer carrier for carrying developer and developer-charge-eliminating means for eliminating the charge on developer on the developer carrier. The developer-charge-eliminating means includes a charge-eliminating member which contacts the developer carrier and a conductive member which contacts the back surface of the charge-eliminating member, wherein the electrical resistivity of the conductive member can be smaller than that of the charge-eliminating member.

In the developing apparatus for this embodiment, when voltage is applied to the developer-charge-eliminating means for eliminating charge, the voltage is directly applied to the conductive member behind the charge-eliminating member first, and then to the charge-eliminating member through the conductive member. At this point, for the developer-charge-eliminating means as a whole, most of the current for eliminating charge flows in the conductive member since electrical resistivity of the conductive member is smaller than that of the charge-eliminating member. Since the potential drop of a conductive member which has small electrical resistivity is proportionally small, the potential of the conductive member is almost uniform along its width. As a result, the potential of a charge-eliminating member which contacts the conductive member is substantially uniform across its length. Accordingly, voltage is uniformly applied to toner remaining on the developer carrier and the charge of the developer is eliminated even though the developer-charge-eliminating means may not contact the developer carrier firmly.

In this embodiment, electrical resistivity of the charge-eliminating member is preferably more than 100 times of that of the conductive member so that most of the charge-eliminating current flows to the conductive member.

Further, in the inventive image forming apparatus using the inventive developing apparatus, the occurrence of image defects such as fog is suppressed and excellent images can be obtained. Since developer on the development carrier is thoroughly replaced after every development, the next development is carried out with a thin layer of developer newly and uniformly formed on the developer carrier.

A development method according to the present invention includes a first step of supplying developer from a developer carrier to an image retaining carrier, a second step of eliminating charge on developer remaining on the developer carrier after the first step by causing an uneven-surfaced elastic member to contact the developer carrier, and a third step of collecting developer(the charge of which is eliminated by the second step) from the developer carrier. Thereby a latent image on the image retaining carrier is developed by the developer carrier.

According to the inventive development method, after developer is supplied to the image retaining carrier, the charge of toner remaining on the developer carrier after development is eliminated by the uneven surfaced elastic member in the second step. Since the elastic member has an uneven surface, the charge of the entire thickness of the layer of developer on the developer carrier is eliminated in the second step. Accordingly, toner on the developer carrier is thoroughly removed in the third step. After that, a layer of developer is newly formed on the developer carrier, and then the first step starts again. Thus, the first step for each development method cycle starts with a uniform and newly formed thin layer of toner which has been thoroughly replaced. Therefore, the occurrence of image defects such as fog are diminished and excellent images can be obtained.

DETAILED DESCRIPTION OF PREFERRED EMBODIMENTS

The detailed aspects of embodiments for the inventive developing apparatus will be explained based on the drawings. The embodiments relate to a developing apparatus using a non-magnetic, one-component developer used for an electrophotographic-type image forming apparatus. In the following embodiments, the same numbers are allocated to parts identical to the parts of the conventional developing apparatus 100.

A. A First Embodiment

Figure 1:
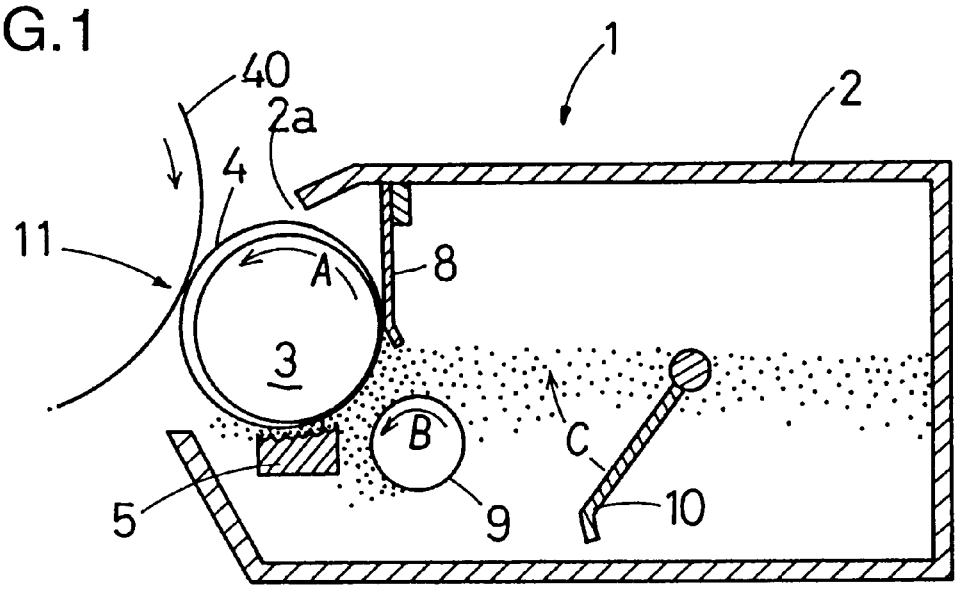
FIG. 1 is a schematic diagram showing a developing apparatus according to the first embodiment.

As shown in FIG. 1, a developing apparatus 1 according to the first embodiment includes a developer storage tank 2 for storing developer (namely, toner), a development sleeve 4 for carrying toner, a supply roller 9 for supplying toner to the development sleeve 4, and a stirring blade 10 for stirring toner present in the developer storage tank 2, or the like.

The development sleeve 4 is a conductive cylindrical body molded by electroforming aluminum, or the like. The development sleeve 4 is installed with a portion protruding from an opening 2*a* of the developer storage tank 2. The development sleeve 4 faces to a photosensitive drum 40 at the protruding portion. A rotating body 3 is provided inside the development sleeve 4. The circumferential length of the development sleeve 4 is slightly longer than that of the rotating body 3. The development sleeve 4 is pressed leftward and slightly upward in FIG. 1. Thereby, a peripheral surface of the development sleeve 4 contacts the photosensitive drum 40. At a reverse side, an inner surface of the development sleeve contacts a peripheral surface of the rotating body 3. Thereby, the development sleeve 4 rotates in a direction indicated by an arrow A along with the rotation of the rotating body 3.

Figure 2:
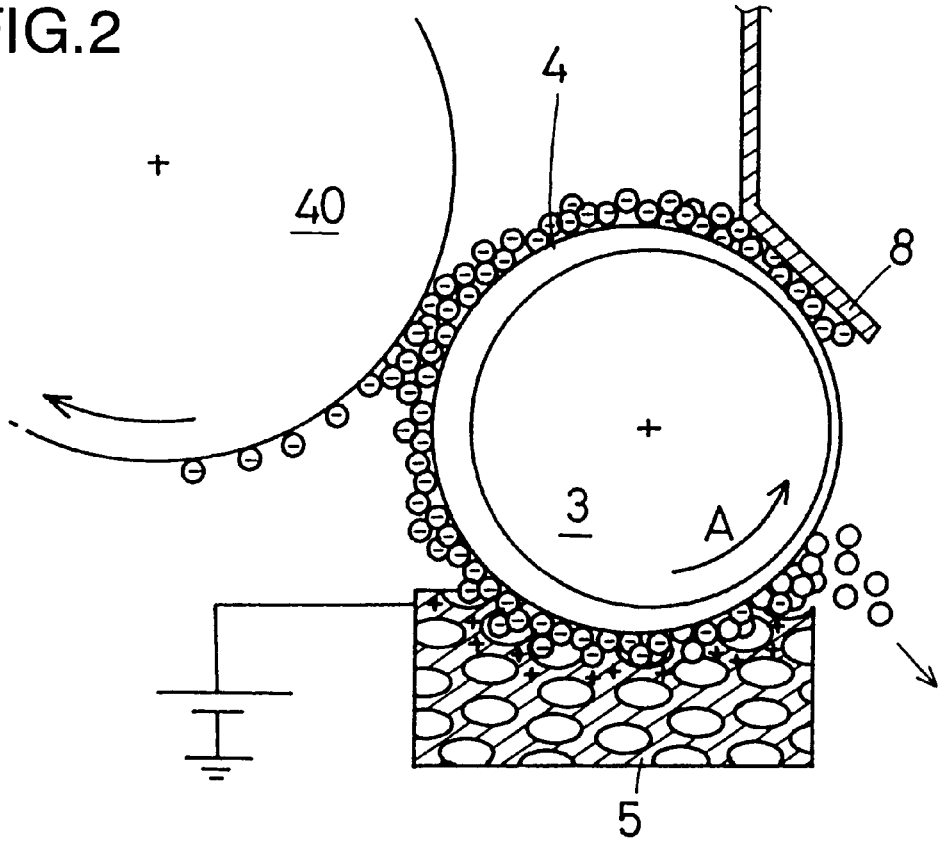
FIG. 2 is a magnified diagram showing the vicinity of a development sleeve according to FIG. 1.

A charge-eliminating member 5 presses and contacts the lower part of the development sleeve 4, downstream side of a contact zone 11 (hereafter referred as the "development zone 11") where the photosensitive drum 40 contacts the development sleeve 4. Preferably, the charge-eliminating member 5 is formed of conductive polyurethane foam which is an elastic member formed of a foamed sponge in order to firmly contact the development sleeve 4. Preferably, the foamed cells are continuous-type foam. In order to obtain a high charge-eliminating effect, an elastic member with 20–80 cells/25 mm and surface resistance value of $10^2$–$10^8$ Ω is used for the charge-eliminating member 5. As shown in FIG. 2, at the side contacting the development sleeve 4, the charge-eliminating member exposes a foamed-state uneven surface. Voltage for eliminating charge is applied to the charge-eliminating member 5 by the main body of the image forming apparatus. In other words, voltage opposite to the polarity of the charged toner is applied to the charge-eliminating member 5.

Further, upstream of the development zone 11 of the development sleeve 4, the regulating blade 8 is made to press and contact the developer sleeve 4 with its upper portion fixed to the developer storage tank 2, and with its edge bent at a desired angle. The regulating blade 8 both creates a uniform amount of toner on the development sleeve 4 and negatively charges the toner by friction.

Next, the operation of the developing apparatus 1 will be explained. First, toner present in the developer storage tank 2 is stirred by the stirring blade 10. Stirring blade 10 rotates in a direction indicated by arrow C and pushes out toward the supply roller 9 at the same time. Then, the toner charged by friction due to contact with the rotating supply roller 9 electrostatically adheres to the periphery of the supply roller 9. Next, toner is transported to an area where the supply roller 9 and the development sleeve 4 face each other by the rotation of the supply roller 9 in a direction indicated by arrow B, and is then supplied to the development sleeve 4. Toner carried onto the periphery of the development sleeve 4 is transported to the contact zone where the regulating blade 8 contacts the development sleeve 4 along its direction of rotation indicated by arrow A. Toner is leveled to a thin-layer state by the regulating blade 8 and charged by friction. Toner carried onto the development sleeve 4 in a uniform, thin-layer state in the direction indicated by arrow A, and then reaches a development zone 11 (i.e., the contact zone where the photosensitive drum 40 and the development sleeve 4 contact each other). Toner is supplied for an electrostatic latent image formed on the photosensitive drum 40. Thereby, the electrostatic latent image is developed into a toner image. The toner image is transferred onto a recording medium, such as printing paper, and an image is formed.

After that, as shown in FIG. 2, the excess toner (toner not used in development) is transported in a direction indicated by arrow A with the rotation of the development sleeve 4 and then contacts the charge-eliminating member 5. As described, the charge-eliminating member 5 is arranged so that it can contact the development sleeve 4 without a space there between. Further, the surface of the charge-eliminating member 5 which contacts the development sleeve 4 is a foamed-state uneven surface. Thereby, the charge-eliminating member 5 has a large contact probability and large frictional resistance with the toner remaining on the development sleeve 4. Subsequently, voltage for eliminating charge is applied to all of the toner on the development sleeve 4. As a result, all of the toner which has passed the charge-eliminating member 5 can be removed from the development sleeve 4. Then, the stirring blade 10 and the supply roller 9 transport the toner present in the developer storage tank 2 to the development sleeve 4 from which toner has thoroughly been removed to form a new thin layer of toner. That is, toner on the development sleeve 4 is thoroughly replaced with a new one.

As described above, in the developing apparatus 1 according to this embodiment, the charge-eliminating member 5 is made of a conductive elastic member formed of a foamed sponge structure. The charge-eliminating member 5 has a foamed-state uneven surface which contacts the development sleeve 4. Thereby, both the contact probability and the frictional resistance with the toner remaining on the development sleeve 4 are high. Subsequently, voltage for eliminating charge is applied to all of the toner on the development sleeve 4 so that all of the toner remaining on the development sleeve 4 is surely removed. Then, a thin layer of toner is newly formed on the development sleeve 4 again. That is, toner to be carried onto the development sleeve 4 is thoroughly replaced with new toner every development cycle, and thereby, development is carried out with a constantly new and uniform thin layer of toner. Therefore, the occurrence of defective images including fog, or the like, is suppressed and excellent images can be obtained.

The present embodiment is an example and does not limit the present invention in any respect. Accordingly, the present invention can be improved and changed while not departing from the subject matter within the scope of the invention. For example, in this embodiment, a conductive elastic member formed of a foamed sponge structure is used for the charge-eliminating member 5 and its contact surface which contacts the development sleeve 4 is a foamed-state uneven surface. However, any conductive elastic member with a contact surface having a certain degree of roughness may be used. Moreover, the type of foam cells which are included in an elastic member is not limited to continuous-type cells, isolated-type cells may also be used.

B. A Second Embodiment

Figure 3:
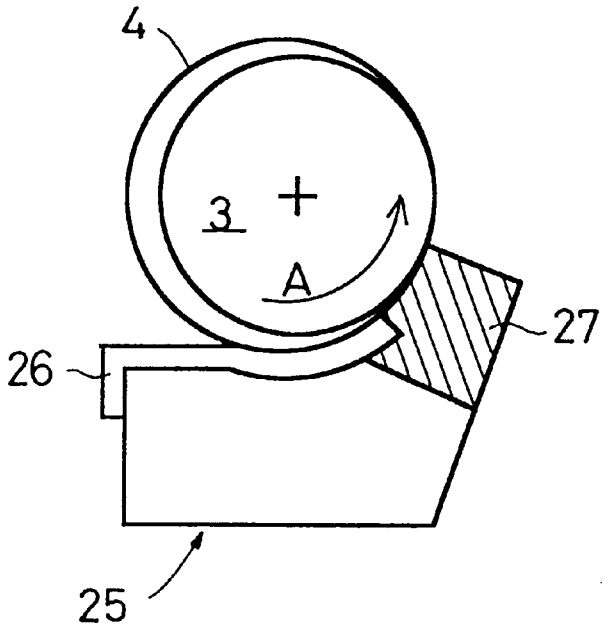
FIG. 3 is a magnified diagram showing the vicinity of a development sleeve according to a second embodiment.

In a developing apparatus according to the second embodiment, its entire structure and operation is almost the same as the developing apparatus according to the first embodiment. The second embodiment differs from the first in details of its charge-eliminating member. That is, in the developing apparatus of the second embodiment, a charge-eliminating sheet and a foamed body eliminate charge on the toner. More specifically, as shown in FIG. 3, a charge-eliminating sheet 26 and a foamed body 27 are combined and used as a charge-eliminating member 25. More particularly, a conductive fluorocarbon resin sheet and a charge-eliminating member which is identical to the one mentioned in the first embodiment are used for the charge-eliminating sheet 26 and the foamed body 27, respectively.

In this embodiment, the charge-eliminating member 25 eliminates charge on toner remaining on a development sleeve 4 after development. The toner remaining on the development sleeve 4 is first eliminated by the charge-eliminating sheet 26, and then by the foamed body 27. Since the foamed body 27 has foamed-state uneven surface, the contact probability and frictional resistance with the toner remaining on the development sleeve 4 is large. Thereby, voltage for eliminating charge is applied to charges toner which the charge-eliminating sheet 26 has not eliminated. Thus, with the two-step charge elimination, the charge of toner remaining on the development sleeve 4 after development is surely eliminated. Thereby, the toner remaining on the development sleeve 4 is surely removed before the next development cycle. Toner present in a developer storage tank 2 is again supplied by a stirring blade 10 and a supply roller 9. Thus, a new thin layer of thoroughly replaced toner is formed on the development sleeve 4.

In the developing apparatus according to the second embodiment, a charge-eliminating sheet 26 and a foamed body 27 are combined and used as a charge-eliminating member 25. Thereby, the charge-eliminating member 25 eliminates charge on toner remaining on the development sleeve 4 after development in two steps. Therefore, excellent charge-eliminating effect is secured and whereby, the developer remaining on the development sleeve 4 after development is surely removed.

Figure 4:
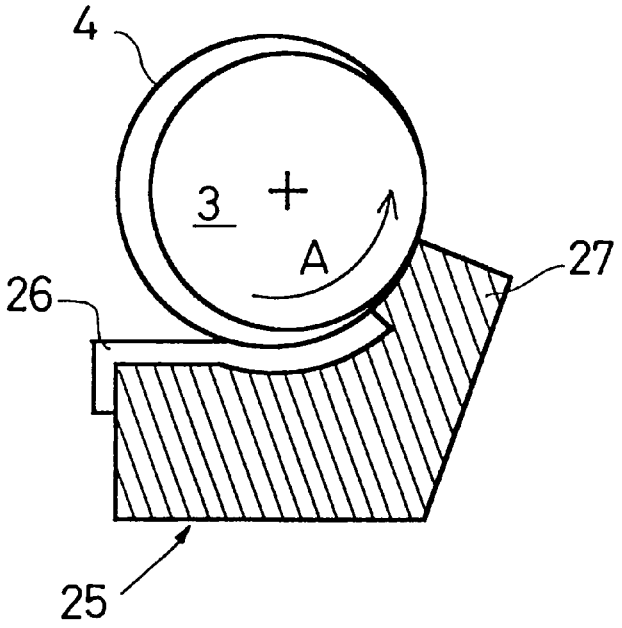
FIG. 4 shows a variant of the second embodiment.

In this embodiment, the charge-eliminating member 25 is composed of a pressing member for pressing the charge-eliminating sheet 26 and the foamed body 27 against the development sleeve 4. However, as shown in FIG. 4, the foamed member 27 can be formed to fill the role of a pressing member for pressing the charge-eliminating member 26.

C. A Third Embodiment

Figure 5:
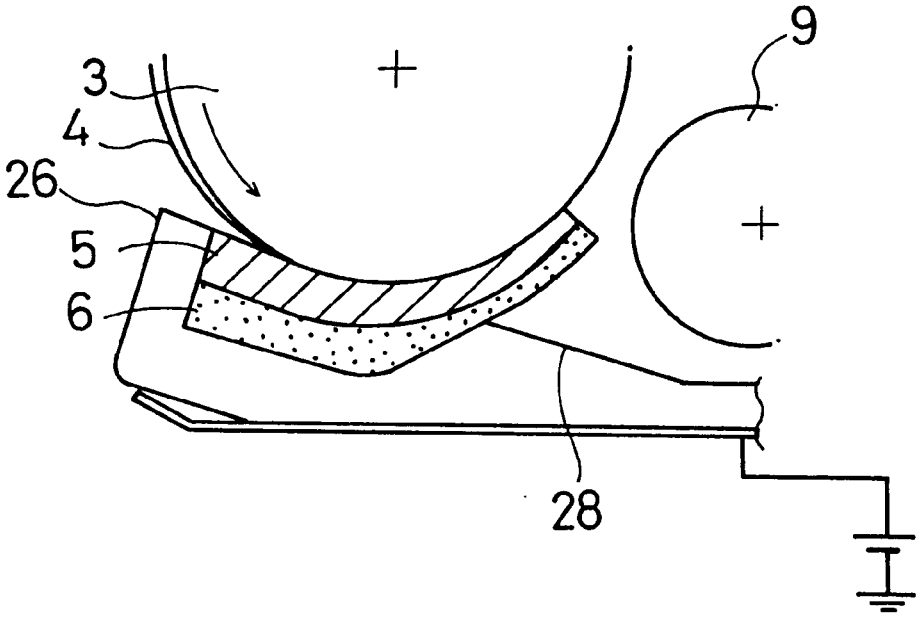
FIG. 5 shows a main part of a developing apparatus according to a third embodiment.

In a developing apparatus according to the third embodiment, its entire structure and operation are almost the same as the developing apparatus according to the first embodiment. The third embodiment differs from the second embodiment in the details of its charge-eliminating member. That is, a back-up member made of a more flexible elastic body is provided on the back surface of a charge-eliminating member 5. More specifically, as shown in FIG. 5, a back-up member 6 is provided beneath the charge-eliminating member 5. The back-up member 6 is located and pressed between a frame 28 and the charge-eliminating member 5. Similar to the charge-eliminating member 5 according to the first embodiment, the charge-eliminating member 5 according to this embodiment is a contact type charge-eliminating member made of conductive polyurethane foam which has a foamed sponge structure. Voltage for eliminating charge is applied to the charge-eliminating member 5 via a charge-eliminating sheet 26.

Figure 6:
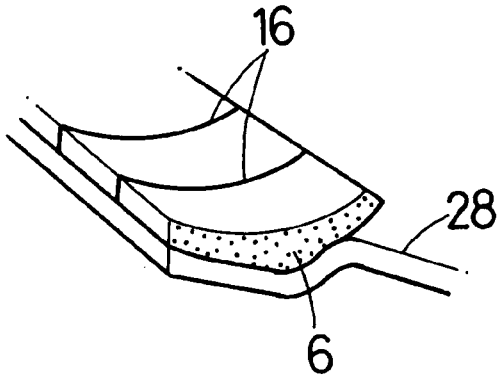
FIG. 6 shows a back-up member for a developing apparatus according to FIG. 5.

The back-up member 6 is less hard and more flexible than the charge-eliminating member 5. For example, an elastic member made of a foamed sponge structure, which is similar to the charge-eliminating member 5, can be used for a back-up member. However, when such an elastic member is used, it is preferable that the elastic member which has more cells than the charge-eliminating member 5. Further, the back-up member 6 is formed of non-conductive insulating material. The back-up member 6 included in the developing apparatus is compressed in thickness (in an up-and-down direction in FIG. 5). As shown in FIG. 6, the back-up member 6 has slits 16 arranged along the width thereof generally in the direction of rotation of a development sleeve 4. The back-up member 6 includes some sections divided by the slits 16.

In this embodiment, the back-up member 6, which is more flexible than the charge-eliminating member 5 is provided beneath the charge-eliminating member 5, and is compressed so that the charge-eliminating member 5 is pressed to the development sleeve 4. Thereby, the charge-eliminating member 5 can more surely eliminate charge on developer remaining on the development sleeve 4. Moreover, even when plastic deformation occurs, and the charge-eliminating member 5 becomes thinner due to deterioration after extended use, the charge-eliminating member 5 surely keeps contacting the development sleeve 4 because the back-up member 6 presses the charge-eliminating member 5 against the development sleeve 4. Since the back-up member 6 is more flexible than the charge-eliminating member 5, the back-up member 6 is hard to plastically deform and maintains its elasticity. Further, since the back-up member 6 is divided into sections by the slits 16, appropriate elasticity works at each section of the back-up member 6 even though elasticity force differs at various points along the width of the development roller 4. Thereby, the contact pressure between the charge-eliminating member and the development sleeve 4 is uniformly maintained.

That is, in the developing apparatus according to the third embodiment, the back-up member 6, which is more flexible, presses the charge-eliminating member 5 toward the development sleeve 4. Therefore, the charge-eliminating member 5 can surely contact the development sleeve 4. Subsequently, charge on toner remaining on the development sleeve 4 is surely eliminated and the toner smoothly removed, whereby excellent images can be obtained. Particularly, the charge-eliminating member 5 can continue contacting the development sleeve 4 even after extended use. Even though the development sleeve 4 can have poor uniformity, charge on toner remaining on the development sleeve 4 can be eliminated and the toner can surely be uniformly removed along the width of the development sleeve 4.

The back-up member 6 in this embodiment is formed of insulating material. However, alternatively, it can be conductive material. Further, the slits 16 for the back-up member 6 can have width. Still further, the slits may be slits which divide the back-up member 16 thoroughly, or ditch-like slits which do not divide the back-up member thoroughly.

D. A Fourth Embodiment

Figure 7:
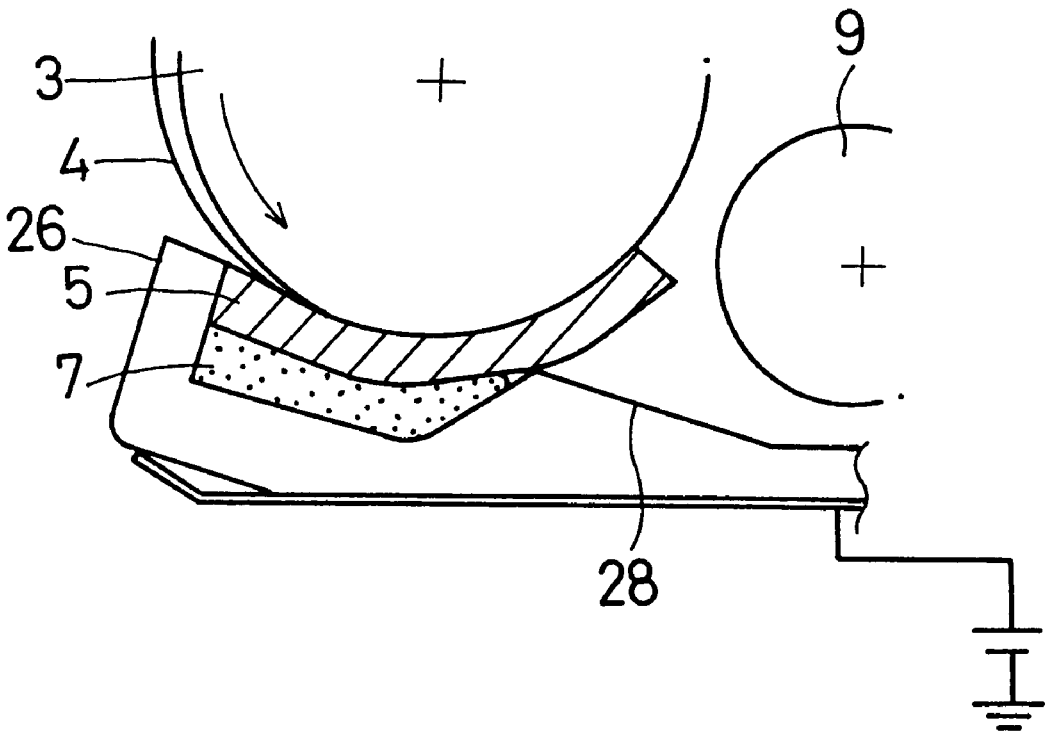
FIG. 7 shows a main part of a developing apparatus according to a fourth embodiment.

In a developing apparatus according to the fourth embodiment, its entire structure and operation is almost same as the developing apparatus according to the third embodiment other than the details of its back-up member. That is, as shown in FIG. 7, a back-up member 7 which is shorter than a charge-eliminating member 5 is used. Similar to the third embodiment, the back-up member 7 has slits. Other than these parts, the structure of the developing apparatus of the fourth embodiment is same as that of the third embodiment. In the fourth embodiment, the length of the back-up member 7 is shorter than that of the third embodiment, and the rotational resistance of a development sleeve 4 is proportionally lower than the third embodiment.

That is, it should be recognized that an arrangement of a back-up member according to the third embodiment is likely to increase torque necessary for driving development sleeve 4. However, as shown in the fourth embodiment, the increase in the required driving torque can be minimized when the length of the back-up member 7 is minimized while still being long enough for the charge-eliminating member 5 to contact and press against the development sleeve 4. Accordingly, in the fourth embodiment, the charge-eliminating member 5 surely continues contacting the development sleeve 4 and the need for excessive driving torque for the development sleeve 4 is prevented. Therefore, the developing device requires small-powered motors to drive the development sleeve 4, and power consumption is reduced proportionately.

E. A Fifth Embodiment

Figure 8:
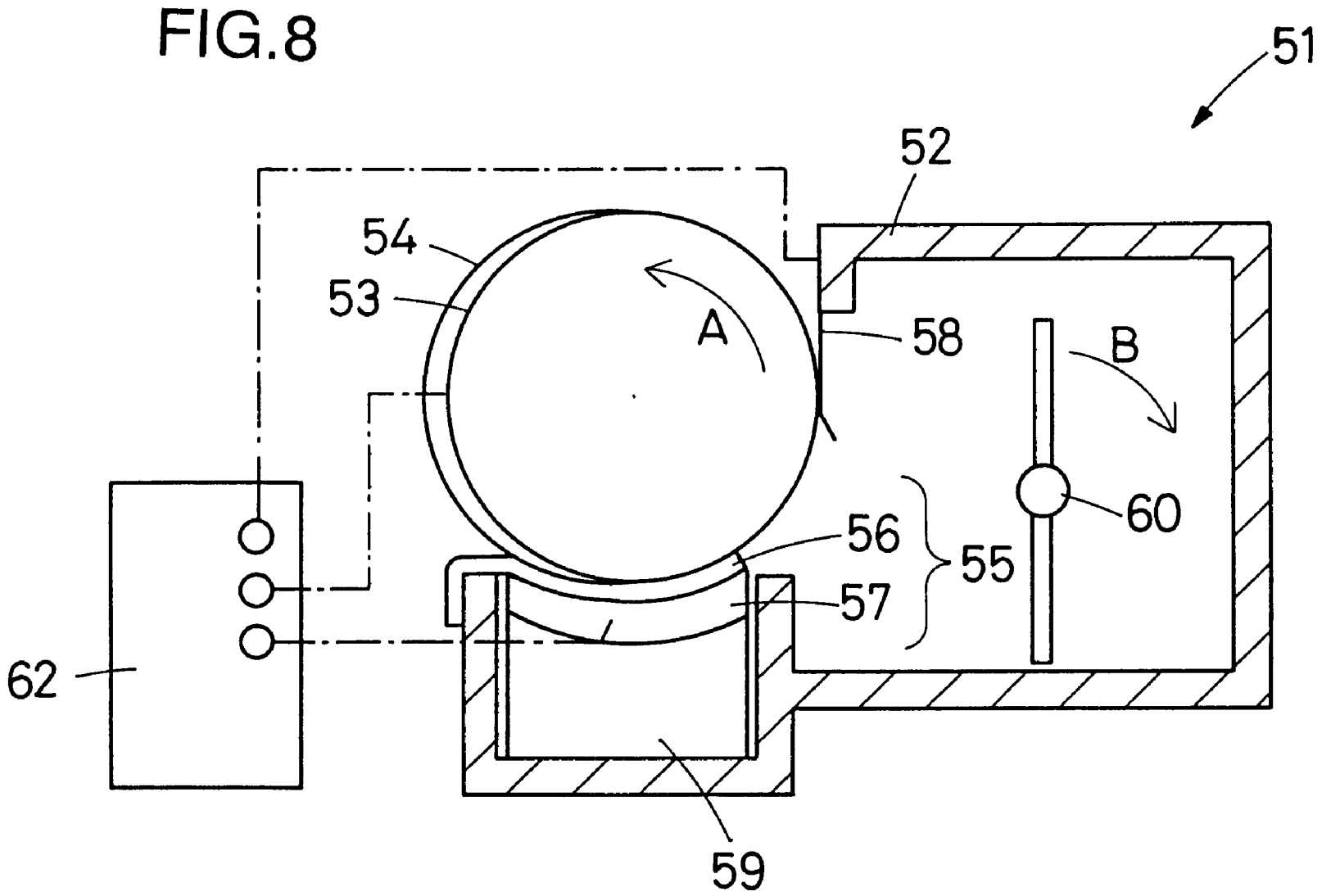
FIG. 8 is a schematic diagram showing a developing apparatus according to a fifth embodiment.

As shown in FIG. 8, a developing apparatus 51 according to the fifth embodiment includes a developer storage tank 52 for storing toner, a development sleeve 54 for carrying toner, a stirring blade 60 for stirring toner present in the developer storage tank 52 by rotating in the direction indicated by arrow B and an electric power unit for applying voltage for eliminating charge or for developing a bias charge, or the like. The stirring blade 60 also supplies toner to the development sleeve 54.

The development sleeve 54 is a conductive cylindrical body molded by electroforming aluminum. The development sleeve 54 is installed with a portion protruding from the developer storage tank 52. A driving roller 53 is provided inside the development sleeve 54. The circumferential length of the development sleeve 54 is slightly longer than that of the driving roller 53. The development sleeve 54 is pressed leftward and slightly upward in FIG. 8. Thereby, an inner circumferential surface of the development sleeve 54 is made to contact with the driving roller 53. Thereby, the development sleeve 54 is made to rotate in a direction indicated by arrow A along with the rotation of the driving roller 53.

A complex sheet 55 in which a charge-eliminating sheet 56 and a sheet member 57 are glued together, and a press-contact member 59 press and contact the lower part of the development sleeve 54. An elastic polyurethane foam may be used for the press-contact member 59. The charge-eliminating sheet 56 employs a conductive fluorocarbon resin sheet which has abrasion resistance, flexibility, and a surface resistance value of about $10^3$ Ω. The charge-eliminating sheet also resists melted toner adhering thereto. On the other hand, the sheet member 57 employs a metal sheet with high flexibility and low surface electrical resistivity (about 10 Ω). Further, the electric power unit 62 applies voltage for eliminating charge to the sheet member 57. The polarity of the voltage applied is opposite the polarity of the charged toner.

Figure 9:
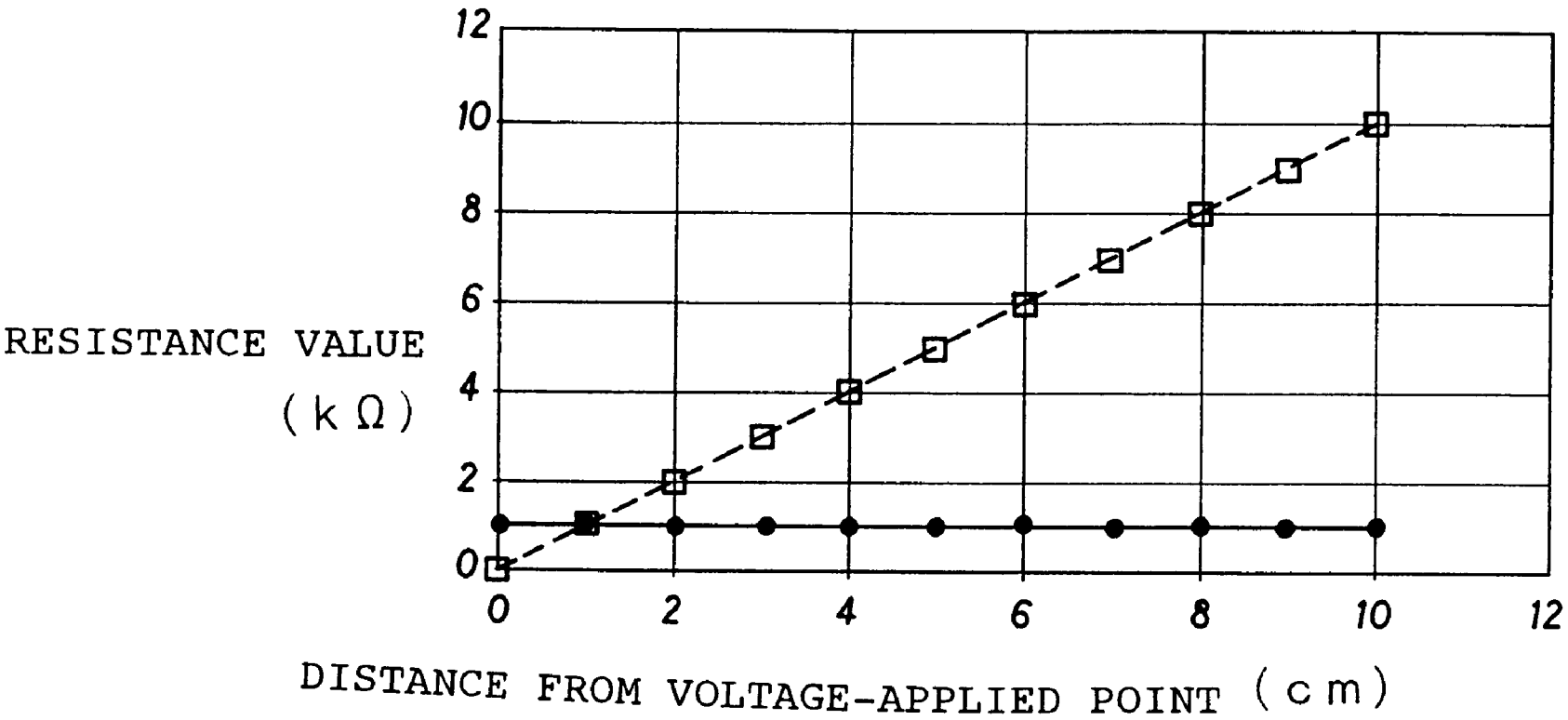
FIG. 9 is a graph showing resistance values for distances from a voltage-applied point.

Resistance values of a developer-charge-eliminating member are shown in FIG. 9. FIG. 9 shows resistance values for various distances from a point where voltage is applied (the voltage-applied point), wherein the solid line and the broken line represent resistance values of the complex sheet 55 and a conventional charge-eliminating sheet, respectively. As is apparent from FIG. 9, in case of the conventional charge-eliminating sheet, the longer the distance from the voltage-applied point, the larger the resistance value is. This means that as the distance from a voltage-applied point increase, the potential drop becomes larger and whereby, the charge-eliminating effect decreases.

On the other hand, for the present embodiment, it is apparent that resistance value of the complex sheet 55 is almost constant regardless of the distance from voltage-applied point. That is, almost a constant voltage for eliminating charge is applied to the complex sheet 55, regardless of distance from voltage-applied point. Since electrical resistivity of the sheet member 57 is smaller than that of the charge-eliminating sheet 56, most of the current for eliminating charge flows in the sheet member 57. Since electrical resistivity of the sheet member 57 is small, the extent of the potential drop is fixed and thereby, the potential drop is insignificantly small. Subsequently, electrical potential is uniform across the entire sheet member 57. Further, electrical potential is uniform across the entire charge-eliminating sheet 56 which contacts the sheet member 57.

Further, the regulating blade 58 presses and contacts the developer sleeve 54 with its upper part fixed to the developer storage tank 52 and with its edge bent at a desired angle. The regulating blade 58 causes a uniform amount of toner to be carried onto the development sleeve 54 and negatively charges the toner with friction.

Next, the operation of the developing apparatus 51 will be explained. First, toner present in the developer storage tank 52 is stirred by the stirring blade 60 along a direction of rotation indicated by arrow B and is supplied to the development sleeve 54. Then, the toner is carried onto a periphery of the development sleeve 54 and is transported to a contact zone where the regulating blade 58 contacts the development sleeve 54 along the direction of rotation indicated by arrow A. Toner is leveled to a thin-layer by the regulating blade 58 and is charged by friction. Then, development is carried out with the thin-layer of toner carried onto the development sleeve 54.

After that, the excess toner not used for development, that is, the toner remaining on the development sleeve 54 after development, is transported along with the rotation of the development sleeve 54 and then reaches the contact point where the charge-eliminating sheet 56 contacts the development sleeve 54. There, charge is eliminated. Since a voltage lower than the development bias voltage by about 100V in absolute value is applied to the sheet member 57, the voltage is also uniformly applied to the charge-eliminating sheet 56, as mentioned in the foregoing discussion. Moreover, since toner remaining on the development sleeve 54 passes and contacts the charge-eliminating sheet 56 under the above-described condition, voltage for eliminating charge is uniformly applied to the remaining toner. Thereby, charge on toner is eliminated. Accordingly, contact pressure between the complex sheet 55 and the development sleeve 54 is not necessarily high.

As a result, all of the toner which has passed the charge-eliminating sheet 56 is removed from the development sleeve 54. Then, the stirring blade 60 again transports toner present in the developer storage tank 52 to the development sleeve 54 (from which toner has thoroughly removed), to form a new thin layer of toner of the above-described operation. That is, toner on the development sleeve 54 is thoroughly replaced with new toner. Since the charge-eliminating sheet 56 has a large electrical resistivity, overcurrent never flows from the development sleeve 54 even if the charge-eliminating sheet 56 directly contacts the development sleeve 54 because toner on the development sleeve 54 has run out for some reason.

As described above, in the developing apparatus 51 according to the fifth embodiment, the charge-eliminating member 56 having a large electrical resistivity and the sheet member 57 having a small electrical resistivity are adhered together. Voltage for eliminating charge is applied to the sheet member 57. Thereby, the potential of the charge-eliminating sheet 56 is almost uniform across the charge-eliminating sheet 56. Subsequently, since charge for eliminating opposite charge is uniformly applied to the toner remaining on the development sleeve 54, the charge-eliminating effect is high. Thereby, the toner remaining on the development sleeve 54 is removed even if the contact pressure between the charge-eliminating sheet 56 and the development sleeve 54 is not high. Therefore, toner carried by the development sleeve 54 is replaced with new toner every development cycle and thereby, development is carried out with a constantly new and uniform thin layer of toner. Therefore, the occurrence of defective images with fog, or the like, is suppressed and excellent images can be obtained.

Figure 10:
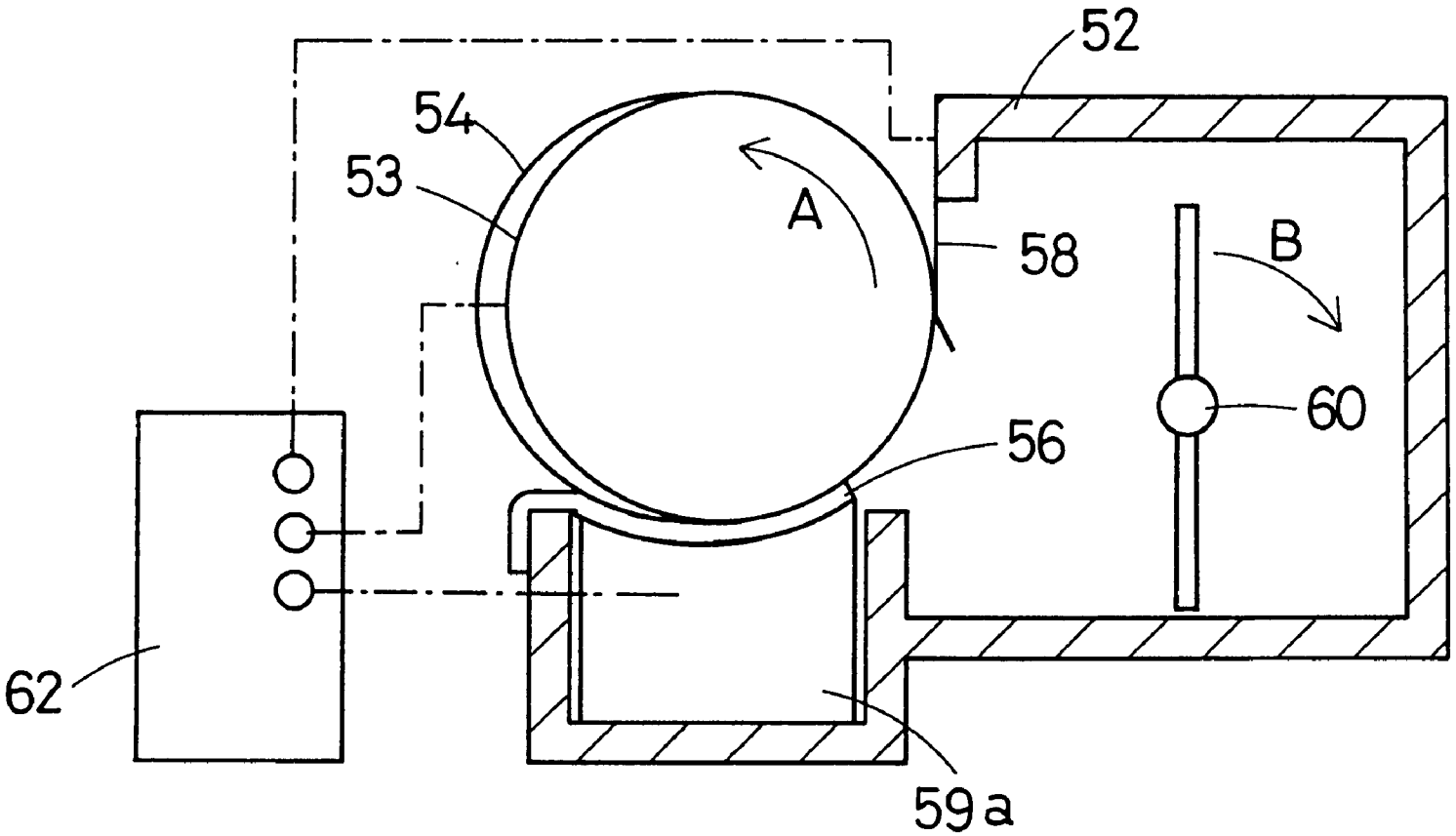
FIG. 10 shows a variant of the fifth embodiment.
Figure 11:
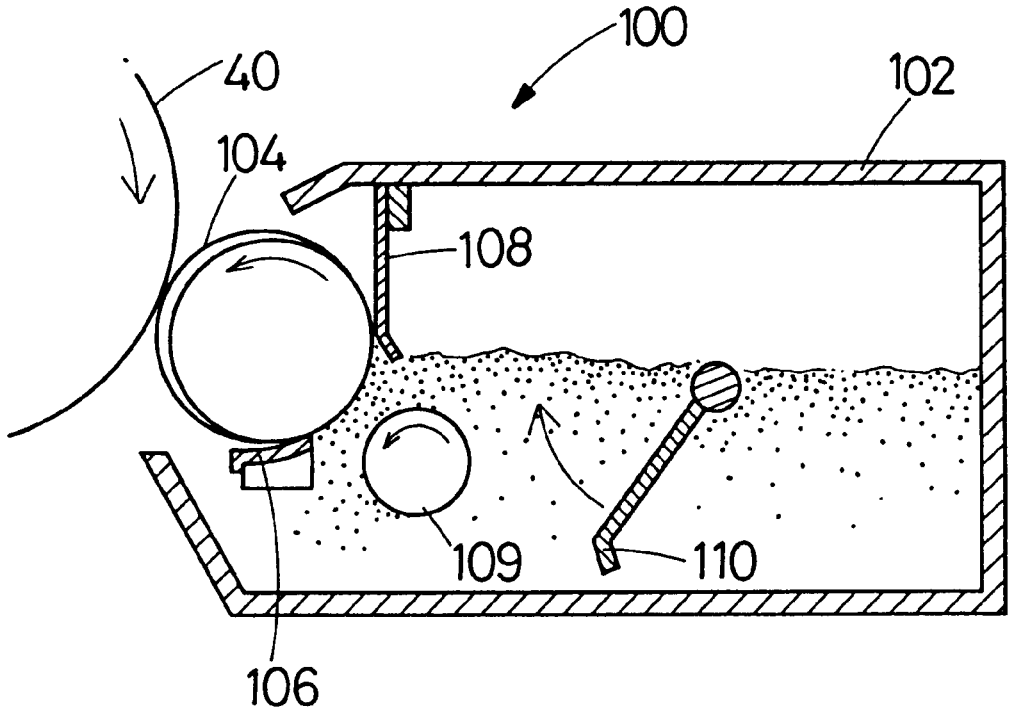
FIG.11 PRIOR ART
FIG. 11 is a schematic diagram showing a conventional developing apparatus.
Figure 12:
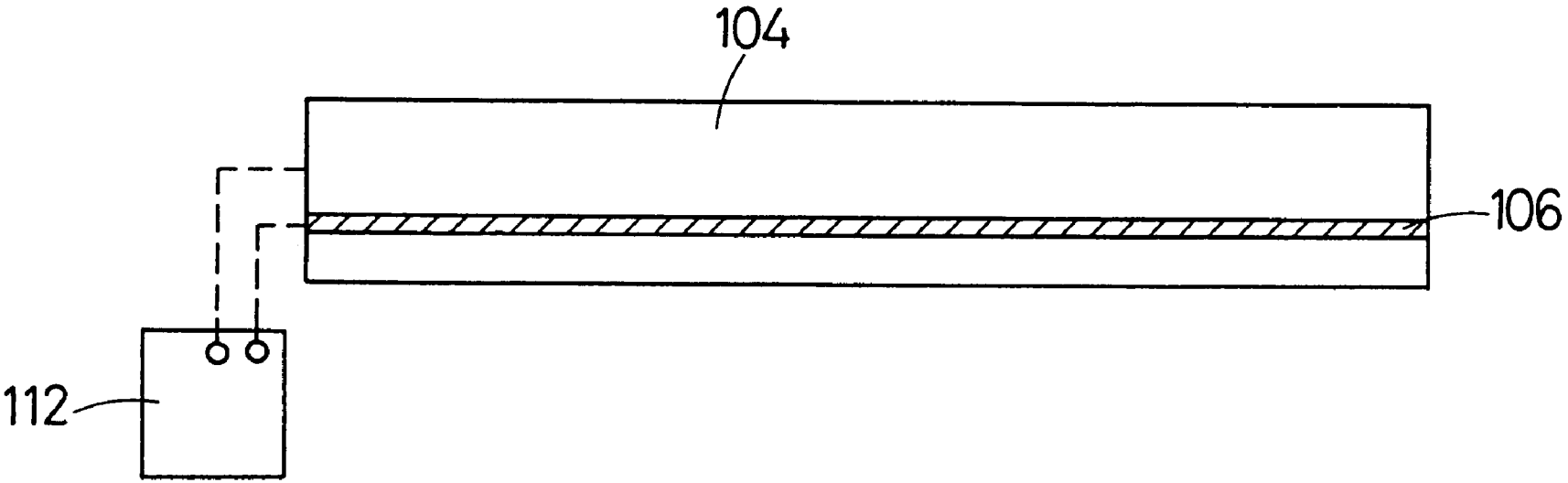
FIG. 12 is a schematic diagram showing the vicinity of a developer-charge-eliminating member for a developing apparatus viewed along a longitudinal direction.

The fifth embodiment is an example and does not limit the present invention in any respect. Accordingly, the present invention can be variously improved and changed without departing from the scope of the invention. For example, as shown in FIG. 10, a developing apparatus may employ a conductive press-contact member 59*a* such as a conductive polyurethane foam which includes portions of a sheet member and a press-contact member and eliminates a separate sheet member 57.

What is claimed is:

1. A developing apparatus comprising:

a developer carrier; and developer-charge-eliminating means for eliminating a charge on developer carried by the developer carrier;

wherein the developer-charge-eliminating means includes an electrically conductive first elastic member which is a foamed body with an exposed foam-state uneven surface and which contacts the developer carrier.

2. A developing apparatus according to claim 1, further including a second elastic member which is arranged on a back surface of the first elastic member, the second elastic member being more flexible than the first elastic member.

3. A developing apparatus according to claim 2, wherein the second elastic member is less hard than the first elastic member.

4. A developing apparatus according to claim 2, wherein the second elastic member has one or more slits located along a direction of rotation of the developer carrier.

5. A developing apparatus according to claim 2, wherein the first elastic member is wider than the second elastic member.

6. A developing apparatus according to claim 2, wherein both the first elastic member and the second elastic member are each formed from a foamed body and wherein the number of foamed cells of the second elastic member is more than that of the first elastic member.

7. A developing apparatus according to claim 2, wherein voltage for eliminating charge is applied to the second elastic member.

8. A developing apparatus according to claim 1, wherein, the first elastic member has a surface resistance value lower than $10^8$ Ω, and includes more than 20 cells/25 mm.

9. A developing apparatus according to claim 1, wherein the foamed body for the first elastic member is formed of a continuous foamed material.

10. The developing apparatus according to claim 1, wherein the foamed body for the first elastic member is formed from a foamed material having isolated cells.

11. The developing apparatus of claim 1, wherein the foamed body includes less than 80 cells/25 mm.

12. An image forming apparatus having a developing apparatus, the developing apparatus comprising:

a developer carrier; and developer-charge-eliminating means for eliminating a charge on developer carried by the developer carrier;

wherein the developer-charge-eliminating means includes an electrically conductive elastic member which is a foamed body with an exposed foam-state uneven surface and which contacts the developer carrier.

13. A developing apparatus comprising:

a developer carrier; and developer-charge-eliminating means for eliminating a charge on developer carried by the developer carrier;

wherein the developer-charge-eliminating means includes an electrically conductive first elastic member which contacts with the developer carrier and a second elastic member which is arranged on a back surface of the first elastic member and which is more flexible than the first elastic member.

14. A developing apparatus according to claim 13 wherein the second elastic member is less hard than the first elastic member.

15. A developing apparatus according to claim 13, wherein the second elastic member has one or more slits located along a direction of rotation of the developer carrier.

16. A developing apparatus according to claim 13, wherein the first elastic member is wider than the second elastic member.

17. A developing apparatus according to claim 13, wherein both the first elastic member and the second elastic member are each formed from a foamed body and wherein the number of foamed cells of the second elastic member is more than that of the first elastic member.

18. A developing apparatus according to claim 13, wherein voltage for eliminating charge is applied to the second elastic member.

19. An image forming apparatus having a developing apparatus, the developing apparatus comprising:

a developer carrier; and developer-charge eliminating means for eliminating a charge on developer carried by the developer carrier;

wherein the developer-charge-eliminating means includes an electrically conductive first elastic member which contacts the developer carrier and a second elastic member which is arranged on a back surface of the first elastic member and which is more flexible than the first elastic member.

20. A developing apparatus comprising:

a developer carrier; and developer-charge-eliminating means for eliminating charge on developer carried by the developer carrier;

wherein the developer-charge-eliminating means includes a charge-eliminating member which contacts the developer carrier and a conductive member which contacts a back surface of the charge-eliminating member, the conductive member having an electrical resistivity that is lower than that of the charge-eliminating member.

21. A developing apparatus according to claim 20, wherein electrical resistivity of the charge-eliminating member is more than 100 times that of the conductive member.

22. A developing apparatus according to claim 20, wherein voltage for eliminating charge is applied to the conductive member.

23. An image forming apparatus having a developing apparatus, the developing apparatus comprising:

a developer carrier; and developer-charge eliminating means for eliminating a charge on developer carried by the developer carrier;

wherein the developer-charge-eliminating means includes a charge-eliminating member which contacts the developer carrier and a conductive member which contacts a back surface of the charge-eliminating member, the conductive member having an electrical resistivity that is lower than that of the charge-eliminating member.

24. A development method for developing a latent image on an image retaining carrier by a developer carrier comprising the steps of:

supplying developer from the developer carrier to the image retaining carrier;

contacting the developer carrier with an exposed foam-state uneven surface of an elastic member which is a foamed body to eliminate charge on developer remaining on the developer carrier after the supplying step; and collecting developer from which charge was eliminated by the eliminating step from the developer carrier.

25. A developing apparatus comprising:

a rotatable developer carrier;

a charge-eliminating sheet for contacting the developer carrier and eliminating some charge on developer carried by the developer carrier;

a foamed body located downstream of the charge eliminating sheet with respect to a direction of rotation of the developer carrier, the foamed body having a foamed-state uneven surface which contacts the developer carrier, the foamed body eliminating charge on developer which was not eliminated by the charge-eliminating sheet; and a pressing member connected to the foamed body and the charge eliminating sheet, the pressing member biasing the charge eliminating sheet and the foamed body against the developer carrier.

26. The development apparatus of claim 25, wherein the charge-eliminating sheet is formed of a conductive fluorocarbon resin.

27. The development apparatus of claim 25, wherein, the pressing member is the foamed body.

* * * * *